United States Patent [19]

Bandai et al.

[11] 4,373,224

[45] Feb. 15, 1983

[54] METHOD FOR MANUFACTURING A DUSTER AND THE DUSTER MANUFACTURED THEREFROM

[75] Inventors: Shinji Bandai, Kawanishi; Masao Kajimaki, Ibaragi; Yoshihiro Nakajima, Osaka; Akira Yagi, Takatsuki; Haruo Nishimura, Osaka, all of Japan

[73] Assignee: Duskinfranchise Kabushiki Kaisha, Osaka, Japan

[21] Appl. No.: 256,254

[22] Filed: Apr. 21, 1981

[51] Int. Cl.[3] ..... A47L 13/40

[52] U.S. Cl. ..... 15/1.5 A; 15/226; 264/22; 300/21

[58] Field of Search ..... 15/1.5, 209 R, 210 R, 15/226, 229; 300/21; 525/240; 264/22, DIG. 45

[56] References Cited

U.S. PATENT DOCUMENTS

| | | | |
|---|---|---|---|
| 3,018,263 | 1/1962 | Schneider | 525/240 X |
| 3,112,300 | 11/1963 | Natta et al. | 525/240 |
| 3,644,605 | 2/1972 | Sessler et al. | 264/22 |
| 3,691,264 | 9/1972 | Asahina | 264/22 |
| 4,245,062 | 1/1981 | Suzuki et al. | 525/240 |
| 4,305,173 | 12/1981 | Isao | 15/226 |

*Primary Examiner*—Edward L. Roberts

*Attorney, Agent, or Firm*—Cushman, Darby & Cushman

[57] ABSTRACT

A method for manufacturing a duster and the duster manufactured therefrom are described, the duster head being made of strands of a blend polymer film of a mixture of isotactic polypropylene and polyethylene, which has been processed to be in an electret state, so that dust collecting and holding efficiency are improved and gross bulk, and texture of the head of the duster are highly improved with rich resiliency and a convenient usage being provided.

7 Claims, 2 Drawing Figures

METHOD FOR MANUFACTURING A DUSTER AND THE DUSTER MANUFACTURED THEREFROM

BACKGROUND OF THE INVENTION

1. Field of the Invention

This invention relates to a method for manufacturing a duster and the duster manufactured therefrom, and more particularly to a method for manufacturing a duster provided with a high dust collecting and holding or capturing efficiency, a high gross bulk, and a superior texture when the duster is in a high condition, a rich resiliency and a highly convenient usage.

2. Description of the Prior Art

Conventional dusters have been made of materials such as feathers and synthetic fibers or fabrics which are apt to be changed by frictional electrification i.e. build-up of a static charge. Recently, split-yarns and/or crimped yarns of polypropylene have been widely employed as the more preferable materials for dusters. The split-yarns of polypropylene by itself are known to be useable for the dusters of the type with which the invention is concerned. There are materials of split-yarn components generally called "polyolefin resin-made" which would seem to include both polypropylene and polyethylene but there is found in the known prior art no duster made of polyethylene. This may be due to the fact that a film of a polyethylene by itself has a difficulty in being split into fibers and/or being crimp finished. For example defects of the quality of the finished goods, or in the manufacturing process are such as that the flocks are apt to be produced, or too much rich resiliency provided causing a felt-like state and/or a ball-like state.

When crimped split-yarns made of polypropylene exclusively are employed, i.e. when even the highest grade split-yarns available by a current process are used, the head of the duster lacks a certain desired resiliency and texture, although a certain desired gross bulk is obtained in the head, and a good quality head is available only when the crimping temperature is not considerably high.

SUMMARY OF THE INVENTION

To this end, the inventors have developed a new material, to overcome such drawbacks, by using a blend polymer of isotactic polypropylene and polyethylene, which new material provides the advantages of both plastic while excluding the disadvantages of each.

The inventors have found that use of a blend polymer of polypropylene and polyethylene of 95:5 to 70:30, preferably 85:15 to 75:25 (by weight) provides a superior material for an improved dusters having a gross bulk, texture, resiliency, etc., in comparison with the material of the sole polypropylene.

Since said blend polymer of polypropylene and polyethylene has a lower thermal deformation temperature in comparison with the polymer of polypropylene by itself, it can be crimped using a lower crimping temperature and can maximally suppress the electret charge attenuation or decay due to thermal heat at the time of the crimping.

On the other hand, in conventional dusters employing frictional electrification, as the duster head has an electric charge either of positive or negative polarity, its external electric field is strong, which sometimes gives an unpleasant feeling to the user due to the frictional electrification charges. Furthermore, an easy transition of the frictional electrification charges from duster to dust makes it easy for the dust to drop-off the duster. Once the dust has fallen, such dust is charged with the same electrical polarity as the duster, either a positive or a negative charge, and as the duster approaches closely to the dust, the dust escapes by electric repulsion force. Such an inconvenient phenomenon causes an incapability of recapturing that dust.

To solve such drawback, the duster of the invention with its head in an electret state has electret charges which are both positive and negative and it provides no unpleasant feeling to the user. Its external electric field is small, and as the electret charges are almost fixed, there occurs no transition of the electret charges, a fact of which assures strong holding of the dust, and even if the once-captured dusts falls, it can be at once re-captured. These superior advantages are provided in the dusters of the present invention.

While the dusters employing frictional electrification charging easily cause the transition of frictional electrification charges and are easily affected by room temperature and humidity thereby to lose the ability to collect and hold dust due to decay of the charges and those dusters are not used at the room temperature and humidity same characteristics through the four seasons, dusters with an electret head according to the present invention have no such drawbacks.

This invention aims to provide a method for manufacturing such dusters with such electret heads made of said excellent materials and the dusters made therefrom.

BRIEF DESCRIPTION OF THE ACCOMPANYING DRAWING

FIG. 1 is a perspective explanatory view of the fabric bundles used to make the duster of the present invention; and FIG. 2 is a longitudinal cross sectional view showing a duster made by the method of this invention.

DESCRIPTION OF THE PREFERRED EMBODIMENTS

Figure 1:
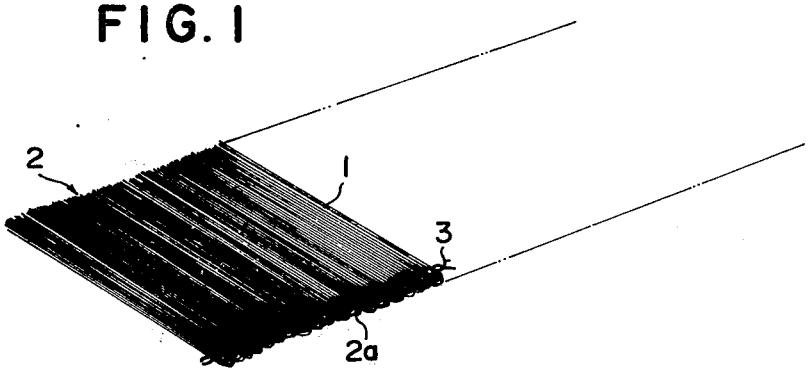

Now, the preferred embodiments of this invention will be hereinafter discussed in details with reference to the accompanying drawing.

Referring to TABLE 1 of this specification, samples 1 through 7 have been prepared by mixing and blending isotatic polypropylene and the polyethylene in various ratios, as the raw materials, as shown in TABLE 1. A film has been produced from such polymers in each such mixing ratio, and the film has been elongated or stretched. The elongation is generally preferably 6.0–to 8.5 times original length. This elongation can be made by any convenient, conventional, per se known means. For example, such elongation is made by passing the material between a pair of pressing rolls rotating at different circumferential speeds at a temperature lower than the softening temperature of the film but higher than the normal temperature.

When the elongation is made under heating, hot rolls, hot plates, heated air bathing and any other convenient heating media are usable. Line speed of the film is not limited but is preferably 60–140 m/min, for the reason of convenient, practical operation. The resulting film is accomplished electret and this is easily made by applying corona charging to the elongated film by means of a corona charging mechanism, such as a combination of many corona wires, a pair of charging electrodes, etc., which are opposite to each other and which have opposite polarity. The running film is closely faced with these electrodes and a high voltage such as 3–15 kV is applied across the gap between the film and the charging electrode and thus the electret treatment or charging is easily made. The gap between the charging electrodes and the film is generally selected to be any convenient gap in the range 3–10 mm, which is suitably determined according to the value of the applied voltage.

The charging may be normally one type but may be more, as the case may be; for example, one surface of the film can be positively corona charged, and the opposite surface can be negatively corona charged.

While the surface potential of the film abruptly attenuates upon termination of the corona charge, it reaches, after a certain duration, a certain saturated potential, thereby permitting the film to be electret.

The electret charging semi-permanently maintains the electrically charged state of the article once charged as was, as so called "permanent electric polarization" and its coexistence of the electret charges in bipolarities permits a small external electric field, which in turn gives no unpleasant feeling to the user. Once contacted with dust, the electret charges never transit to the dust because of the fixed charges, which prevent an easy dust drop-off or the dust can be sooner re-captured even when the it has fallen.

In manufacturing the duster head, the elongated film thus electret charged is then split into a plurality of rows of ribbon-like fibers or fibrils which show a series of a rectangular or diamond shapes when widened or expanded. This operation is easily made by an application of a lengthwise or transverse frictional or mechanical force thereon, by an aid of fibrilation of the film pr se, or by contacting the film onto a rotating needle roll, the last of which is a generally advantageous and convenient method. Pitches of the needles or pins are preferably about between 0.2 to 2 mm.

As an alternative, the yarn-splitting operation is first conducted and then the charging operation can be conducted.

The resulting electret yarns are then crimped.

The yarn crimping is generally produced, by a process wherein the inner organization or tissue is deformed by utilizing a physical or chemical distortion, in which (a) the fibrils or fibers are relaxed in a heated medium such as hot water, vapor and the like, or (b) by strongly twisting the fibrils or strands, or (c) by engaging the fibrils with some mechanical means, or frictionally passed (d) them with such mechanical means, or by contacting the fibrils with the fluid jet, etc., all of which methods are well known.

Any one of the above methods for providing the crimping gives a considerable lower dust collecting or capturing, or holding efficiency of the crimped yarns as the dusters as the commercial products, when the crimping temperature is higher than about 110° C. for the electret splitting-yarns. This reason is not yet fully understood, but it is supposed that the higher the crimping temperature for the operation is, the higher the effect of the crimping is, while the excess deformation and/or relaxing of the inner structure of the fibrils, off-sets the electret effect state.

Referring to the drawing, the resulting electret split and crimped yarns are bundled, with every certain number of the yarns being bundled into a plurality of the yarn bundles 1 as shown in FIG. 1. Each bundle forms a wave-like frond of material 2 for the dusters. Each bundle is engaged with a string or thread 3 in a coil or is spirally engaged and/or engaged in any other form, leaving its loop portion 2*a*, while its other end is cut at its loop portion 2*a* and released.

Figure 2:
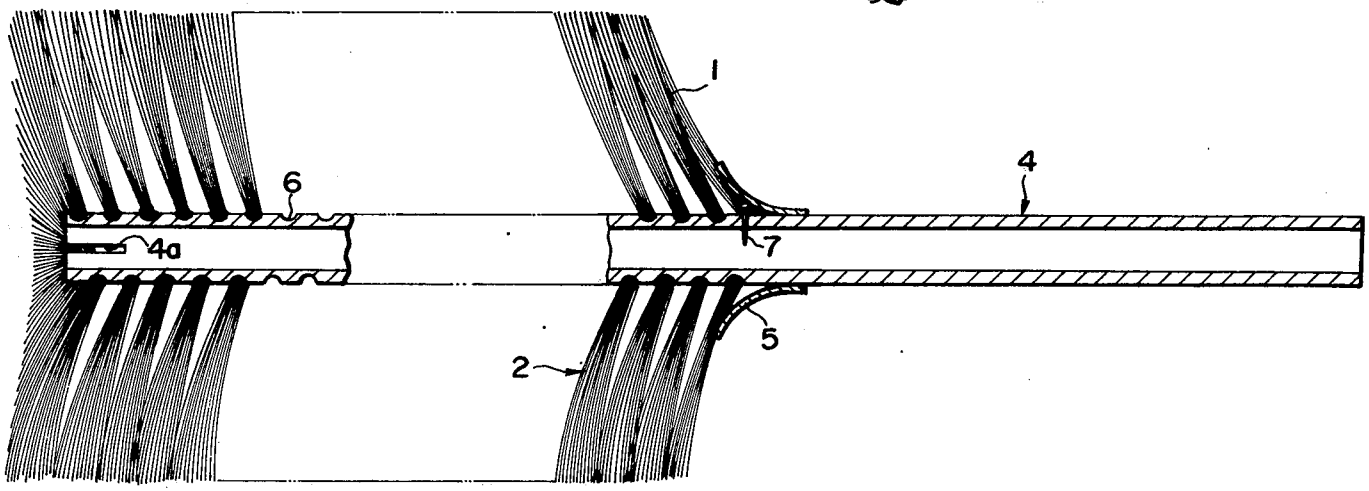

The material 2 thus formed is attached onto the duster stem or grip 4 as shown in FIG. 2. The stem 4 is formed in an elongated cylindrical shape in a certain convenient length as illustrated in FIG. 2, about a center of which a bell frame 5 diverging toward the tip end of stem is attached with an adhesive and the like.

A continuous spiral thread or groove 6 is formed around the cylindrical circumferential wall from the center toward the tip end of stem. The starting basic end of this thread 6 reaches the portion covered with said bell frame 5. A narrow width notch 4*a* is formed along the axial direction of the stem 4 at its tip end.

The duster material 2 is attached onto the stem 4 thus constructed as above, as follows:

The loop portion 2*a* side of the duster material 2, engaged with the string 3 is directed downward and forcibly inserted into the notch 4*a* provided at the tip of the stem 4 and fixed therein. Thereafter, the remaining portion of the material is oriented downwardly at its loop portion 2*a* and the former is wound spirally along around and in the thread 6. Its terminal end is fixed on the stem 4 with a pin 7 within the bell frame 5. Upon fixing of the material 2 thereon, the yarn bundles 1 constituting the material 2 are cut, and the released free ends form a head of the duster radially from the stem in a generally cylindrical shape and thus an elegant and esthetic duster is provided.

A duster head of the duster as above described has been made from the materials shown in Samples 1–7 in the TABLE 1, having aforementioned mixing or blending ratio of the polymers and the gross bulk, resiliency, elastic rigidity, general and total convenience of usage of the dusters, crimp maintaining ability the electret performance, dust holding or capturing ability, etc., have been all tested and examined, and the results are, as shown in TABLE 1:

TABLE 1

| Sample No. | 1 | 2 | 3 | 4 | 5 | 6 | 7 |
|---|---|---|---|---|---|---|---|
| Blend ratio (PP/PE) | 100/0 | 97/3 | 95/5 | 80/20 | 70/30 | 50/50 | 0/100 |
| Gross bulk | C | C | B | B | B | C | D |
| Resiliency | D | D | C | B | B | A | A |
| Elastic rigidity | A | B | B | B | C | D | E |
| Total convenience | D | C | B | A | A | C | D |
| Dust capture | D | C | B | A | A | C | D |
| Total evaluation | D | D | B | A | D | D | E |

Nomenclature:
PP: Polypropylene
PE: Polyethylene
A: Best
B: Good
C: Ordinary
D: Bad
E: Worst Now, convenience of use of the dusters of each sample tabulated in TABLE 1 will be hereunder explained.

No. 1 sample has a too strong an elastic rigidity and lacks the resiliency and the affinitive contact of the head to the object to be cleaned, i.e., to a wall, and therefore is unsuitable for cleaning.

No. 2 sample provides a desirable elastic rigidity but lacks the desired resiliency, and lacks close affinitive contact.

No. 3 sample provides an elastic rigidity and the desired gross bulk but provides a slightly lesser resiliency; it falls in an acceptable range nevertheless for use in manufacture of the duster head.

No. 4 sample provides good conditions as to elastic rigidity, bulk and resiliency.

No. 5 sample shows a slightly lesser elastic rigidity but provides a good gross bulk and resiliency and falls in the employable scope for the duster head.

No. 6 sample provides a desirable resiliency but a weak elastic rigidity and, when used, it assumes a ball-like shape and is unusable for the duster head.

No. 7 sample provides an excessive resiliency and its yarns are stuck together as a whole to form a felt-like condition and accordingly this sample is unusable.

After the above experiments and tests, the total evaluation shows that the Nos. 3–5 samples provide preferable results for employment for the duster head of commercially merchantable products. In other words, the preferable range of the blending ratio of the polypropylene and the polyethylene is by weight 95:5 to 70:30, and 80:20 is the best.

Split and crimped yarn of 2,000 denier in consisting of fibrils of 20 microns in thickness and 0.2 mm in width were used in the experiments and the tests which are tabulated in the TABLE 1.

The inventors have conducted two types of tests for examining the dust collecting or capturing or holding capability, one being the test for checking stained, dirty, darkened color, another being testing the affixing or adsorption of the dusts.

The dirty, darkened color test quotient is calculated as follows:

$$\text{Dirty darkened colored degree} = \frac{A - B}{A} \times 100$$

(where A is brightness clarity before sweeping for cleaning, and B is the brightness after sweeping for cleaning.)

The test result has shown about 44% for the electret split and crimped yarns, and about 25% for the non-electret ones after cleaning in same condition. This result means a duster made of electret split-crimped yarns hold nearly 2 times more dust than the non electret one.

The dust-affixing or capture or catch test has been conducted in such a manner that dusts of identical weight have been uniformly scattered on a plane plate from a dust chamber and we have cleaned with the duster thereon so that the grade of the dust collecting and wipe-off from the plate has been determined by measuring and comparing the total weight of the plane plate before and after the cleaning. The result has shown that the dust-off or dust collecting rate has been 85% for the electret and crimped duster, while 42% for the duster of the non-electret.

As is apparent from the aforementioned explanation, the present invention provides dusters with an excellent dust-collecting or capturing and holding capability, an excellent gross bulk and texture and rich resiliency and the convenient usage.

We claim:

1. A method for manufacturing a duster, comprising the steps of:

(a) providing a film consisting of a blend of isotactic polypropylene and polyethylene polymers, said blend being of a weight ratio in the range 95:5 to 70:30, and substantially elongating the film;

(b) treating the elongated film by a corona charge sufficiently to create an electret state in said elongated film;

(c) splitting the elongated film into a plurality of rows of ribbon-like fibers;

(d) crimping the fibers without substantially eliminating the electret state; and (e) attaching said plurality of rows of crimped ribbon-like fibers to a duster stem.

2. The method of claim 1, wherein:

in conducting step (a) the film is elongated by an amount in the range of 6.0–8.5 times the original length thereof.

3. The method of claim 1, wherein:

in conducting step (b), the corona charge is applied via a plurality of corona charging wires.

4. The method of claim 1; wherein:

in conducting step (e), the crimped ribbon-like fibers are each assembled midway along their length to a respective holder, a plurality of such fibers to each holder to create a respective frond-like row of such fibers; the duster stem being provided with at least one groove along the length thereof, and the holder being inserted in the groove and fastened to the duster stem to mount the fibers to the duster stem.

5. The method of claim 4, wherein:

the at least one groove is spirally provided on the duster stem and said holder of said respective row of fibers is wound into said spirally provided groove, so that said fibers project from the duster stem about the circumference of the duster stem.

6. The method of claim 5, wherein:

the at least one groove extends from one end of the duster stem to a site intermediate that end and an opposite end of the duster stem and the holder is fastened to the duster stem by fastening one end of the holder to said one end of said duster stem and by fastening an opposite end of the holder to said intermediate site on said duster stem.

7. A duster manufactured according to the method of claim 6.

* * * * *